US009221641B2

(12) United States Patent
Dollevoet et al.

(10) Patent No.: US 9,221,641 B2
(45) Date of Patent: Dec. 29, 2015

(54) CONTROLLER AND SYSTEM FOR CONTROLLABLY ROTATING A ROLL OF MATERIAL

(75) Inventors: Mark Gary Dollevoet, Freedom, WI (US); Vivek Moreshwar Karandikar, Neenah, WI (US); Jason Michael Julien, Spanish Fort, AL (US); Jeffrey George Skarda, Broken Arrow, OK (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 512 days.

(21) Appl. No.: 13/466,258

(22) Filed: May 8, 2012

(65) Prior Publication Data

US 2013/0299623 A1 Nov. 14, 2013

(51) Int. Cl.

| | |
|---|---|
| ***G05B 13/02*** | (2006.01) |
| ***B65H 23/198*** | (2006.01) |
| ***B65H 59/38*** | (2006.01) |

(Continued)

(52) U.S. Cl.

CPC ..... *B65H 29/243* (2013.01); *B65H 35/08* (2013.01); *B65H 43/00* (2013.01); *B65H 23/198* (2013.01); *B65H 2301/4451* (2013.01); *B65H 2301/44735* (2013.01); *B65H 2511/11* (2013.01); *B65H 2513/11* (2013.01); *B65H 2515/116* (2013.01); *B65H 2515/12* (2013.01); *B65H 2515/32* (2013.01); *B65H 2515/322* (2013.01); *B65H 2553/40* (2013.01); *B65H 2557/262* (2013.01); *B65H 2801/57* (2013.01)

(58) Field of Classification Search

CPC ..... B65H 2220/01; B65H 2220/02; B65H 2301/44; B65H 2511/11; B65H 2513/11; B65H 43/00; B65H 43/22; B65H 23/00; B65H 18/26

USPC ..... 700/46; 242/534, 75.42, 75, 75.43, 242/75.44, 75.5, 412, 541.1, 75.1; 101/225; 318/6, 7, 461

See application file for complete search history.

(56) References Cited

U.S. PATENT DOCUMENTS 4,278,213 A * 7/1981 Rubruck ..... 242/420.2
4,286,757 A 9/1981 Wirth (Continued)

FOREIGN PATENT DOCUMENTS

JP 04-341451 11/1992
JP 07-315653 A 12/1995

(Continued)

OTHER PUBLICATIONS

International Search Report and Written Opinion for PCT/IB2013/052600 dated Aug. 7, 2013; 9 pages.

*Primary Examiner* — Mohammad Ali
*Assistant Examiner* — Md Azad
(74) *Attorney, Agent, or Firm* — Armstrong Teasdale LLP

(57) ABSTRACT

A controller for a motor is configured to rotate a roll of material. The controller includes a drive speed regulator configured to generate an initial torque command based on a difference between a speed setpoint and a measured drive speed of the motor. The controller also includes an observer module configured to estimate a density error of the roll of material. The initial torque command is adjusted based on the density error to obtain a total torque command. The controller also includes a torque regulator configured to control the motor based on the total torque command.

14 Claims, 3 Drawing Sheets

(51) Int. Cl.

| | |
|---|---|
| ***B65H 77/00*** | (2006.01) |
| ***H02P 1/54*** | (2006.01) |
| ***H02P 5/46*** | (2006.01) |
| ***G05B 5/00*** | (2006.01) |
| ***H02H 7/08*** | (2006.01) |
| ***H02P 1/04*** | (2006.01) |
| ***H02P 3/00*** | (2006.01) |
| ***H02P 5/00*** | (2006.01) |
| ***B41F 13/56*** | (2006.01) |
| ***B65H 29/24*** | (2006.01) |
| ***B65H 43/00*** | (2006.01) |
| ***B65H 35/08*** | (2006.01) |

(56) References Cited

U.S. PATENT DOCUMENTS

| | | | | |
|---|---|---|---|---|
| 6,470,225 | B1 | 10/2002 | Yutkowitz | |
| 6,494,399 | B1 * | 12/2002 | Rautakorpi | 242/541.7 |
| 8,405,338 | B2 * | 3/2013 | Leppa et al. | 318/461 |
| 2003/0005837 | A1 * | 1/2003 | Agne | 101/225 |
| 2012/0126049 | A1 * | 5/2012 | Gruzdaitis | 242/412 |

FOREIGN PATENT DOCUMENTS

| | | | |
|---|---|---|---|
| JP | 2007-084317 | A | 4/2007 |
| WO | 03031297 | A1 | 4/2003 |

* cited by examiner

CONTROLLER AND SYSTEM FOR CONTROLLABLY ROTATING A ROLL OF MATERIAL

FIELD

This invention relates generally to the handling of webs of material, and more particularly to a controller and system for controllably rotating a roll of material.

BACKGROUND

A number of different handling processes are used to process continuous webs of material into defined segments, such as discrete webs cut from a continuous web for subsequent processing. In general, a manufacturing line in which the discrete webs are used includes a pre-wound roll of the continuous web of material that is unwound by a suitable drive mechanism and fed (often through various stations of the manufacturing line) to a cutting station at which the web is cut sequentially into discrete webs of the material. Typically, the continuous web is held in tension as it is transported from the wound roll to the cutting station. The discrete webs are then transported away from the cutting station to another station of the manufacturing line at which the discrete webs are assembled with other components of the product being formed.

Typically, the drive mechanism attempts to maintain a constant tension in the web of material as unexpected changes in tension at one or more points in the manufacturing line may result in undesired tears or breaks in the continuous web of material. Such tears or breaks disrupt the manufacturing process and may cause significant downtime and/or costs to be incurred.

One or more speed setpoints are used to control the unwinding speed of the continuous web of material. If variations occur between the speed setpoint and the actual speed of the web at different points along the web of material, the tension may become mismatched along the web of material. The drive mechanism attempts to track the actual speed of the web to the speed setpoint as closely as possible by controlling the torque generated by the motor.

As the roll of the material is unwound, the inertia of the roll changes. More specifically, the inertia of the roll is based on the density of the material and the amount of material remaining on the roll. At least some known systems use inertia compensation algorithms to adjust the torque of the drive mechanism to compensate for the change in inertia due to the unwinding of the roll. The algorithms typically include a "hardcoded," or static, value for the density of the material, for example, based on a typical or baseline density of the material as measured at a prior point in time. However, the density of the material may change based on environmental factors such as humidity, temperature, and the like, and/or based on other factors. Accordingly, algorithms used in industry today do not accurately compensate for the inertia of the roll of material as it is unwound due to variations in density, thus causing a risk that the continuous web of material may break or tear.

SUMMARY

In one embodiment, a controller for a motor is configured to rotate a roll of material. The controller includes a drive speed regulator configured to generate an initial torque command based on a difference between a speed setpoint and a measured drive speed of the motor. The controller also includes an observer module configured to estimate a density error of the roll of material. The initial torque command is adjusted based on the density error to obtain a total torque command. The controller also includes a torque regulator configured to control the motor based on the total torque command.

In another embodiment, a web handling system for use with a roll of material includes a motor configured to one of unwind and wind the roll of material, and a controller configured to control a drive speed of the motor. The controller includes a drive speed regulator configured to generate an initial torque command based on a difference between a speed setpoint and a measured drive speed of the motor. The controller also includes an observer module configured to estimate a density error of the roll of material. The initial torque command is adjusted based on the density error to obtain a total torque command. The controller also includes a torque regulator configured to control the motor based on the total torque command.

BRIEF DESCRIPTION OF THE DRAWINGS

Corresponding reference characters indicate corresponding parts throughout the drawings.

DETAILED DESCRIPTION

Figure 1:
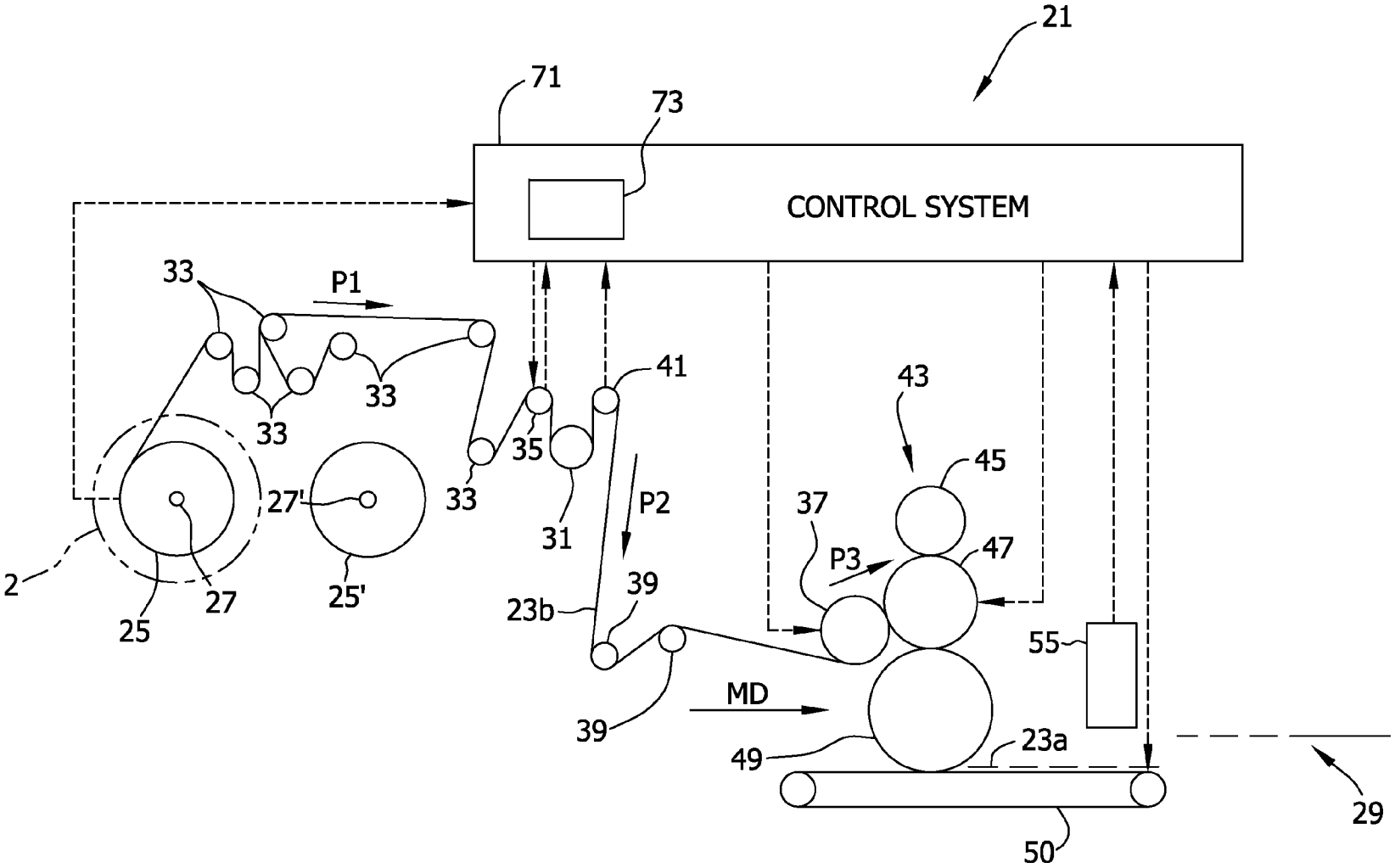
FIG. 1 is a schematic diagram of one embodiment of a web handling system for unwinding a continuous web of material.

With reference now to the drawings, FIG. 1 is a schematic diagram of one example of a web handling system, generally indicated at 21, for creating discrete webs 23*a* of material, such as absorbent material, at a time after the webs are cut from a continuous web 23*b* of material, and more particularly from a wound roll 25 of such a continuous web of material. The illustrated web handling system 21 suitably feeds an absorbent product manufacturing line (a portion of which is indicated generally at 29 in FIG. 1) in which various components of an absorbent product are assembled together as the components, and hence the absorbent product at various stages of assembly thereof, is moved through the manufacturing line in a machine direction MD. Examples of such absorbent products include, without limitation, paper towels, facial tissues, bath tissues, napkins, and the like.

It is understood, however, that the web handling system 21 and methods described herein may be used by itself to produce discrete webs, or to feed a manufacturing line for making articles other than absorbent products, and remain within the scope of this invention. As used herein, the term "machine direction" refers to the direction in which the web 23*b* (and discrete webs 23*a* after cutting) are moved through the web handling system 21.

While the system and methods illustrated and described herein are for a web handling system 21 in which a continuous web is cut into discrete segments of web material, it is also understood that the web handling system and methods described herein may be used to control the length of particular segments (e.g., discrete segments) of a continuous web of absorbent material, such as between registration marks or other markers on a continuous web, following processing of the web during which the web is tensioned and subsequently released in whole or in part from such tension. Accordingly, the term "discrete segment" as used herein is taken to refer to a cut segment of web material cut from a continuous web or to a defined segment of web material (e.g., between registration marks or other markers) along a continuous web.

The web handling system 21 suitably includes an unwind spindle 27 (broadly, an unwind device) on which the wound roll 25 of the continuous web 23*b* of absorbent material is mounted. The illustrated system 21 particularly includes a second unwind spindle 27' and another wound roll 25' of continuous web 23*b* of absorbent material. With this arrangement, when one of the rolls 25 is completely unwound and in need of replacement the system 21 draws from the other wound roll while the unwound roll is being replaced. It is understood, however, that a single unwind device and wound roll 25 may be used without departing from the scope of this disclosure. It is also contemplated that two or more webs 23*b* may be drawn from respective wound rolls and laminated or otherwise secured together to form a continuous web of absorbent material prior to the web being cut into discrete webs 23*a*.

A suitable drive mechanism, such as in the form of a rotatably driven drive roll 31, operates to draw the continuous web 23*b* from the wound roll 25 (thereby unwinding the wound roll) to move the web in the machine direction MD along a first path P1 of the system 21. The unwind spindle 27, according to one embodiment, may also be driven. As the continuous web 23*b* is unwound from the wound roll 25, it is drawn along the path P1 over a series of guide rolls 33 (also sometimes referred to as stationary rolls, or idler rolls) and then over a mobile or stationary dancer roll 35 (broadly, a web tension control) before reaching the drive roll 31. In one embodiment, the dancer roll 35 may be, or may include, an idler roll that includes a load cell for measuring tension of the continuous web 23*b*. A dancer roll 35 is commonly used to control tension in a moving web within a predetermined range of tensions. For example, while the web tension is intended to remain generally constant, it may vary due to factors such as non-uniform web properties, uneven wound rolls or web misalignment, speed changes in the drive roll and other factors. The dancer roll 35 may also be used for monitoring the tension in the web 23*b* as the web is drawn from the wound roll 25 to the drive roll 31 (e.g., based on the pre-determined tension range within which the dancer roll is initially set to maintain the web in tension). It should be understood that, while the wound roll 25 is described herein as being unwound by the drive mechanism and the web handling system 21, the drive mechanism and the web handling system may also be used to wind, or add material to, the wound roll, and/or to otherwise rotate the wound roll to function as described herein.

It is contemplated that other web tension controls may be used to control the tension in the moving web 23*b* after the web is drawn from the wound roll 25. For example, a festoon (not shown) may be used instead of, or in addition to, the dancer roll 35 to control and monitor the tension in the web 23*b*.

The rotational speed of the drive roll 31 generally determines the machine direction MD speed of the web 23*b* as it moves along the path P1 from the wound roll 25 to the drive roll. Tension in the continuous web 23*b* along the path P1 is also at least in part a function of the rotational speed of the unwind spindle 27 if the spindle is driven (i.e., a function of the differential between the drive roll rotational speed and the driven speed of the unwind spindle). Where the unwind spindle 27 is undriven (i.e., generally free to rotate), the tension in the moving web 23*b* along the path P1 is a function of the rotational speed of the drive roll 31 and the inertia of the wound roll 25 and unwind spindle.

A vacuum feed roll 37, located downstream from the drive roll 31 in the machine direction MD of the system 21, is rotatably driven to further draw the continuous web 23*b* in the machine direction along a path P2 from the drive roll to the feed roll. Additional guide rolls 39 are positioned along the path P2 along with a load cell 41 used in a conventional manner to monitor the tension in the web 23*b* as the web is drawn along the path P2 from the drive roll 31 to the vacuum feed roll 37. The tension in the web 23*b* along the path P2 is generally a function of the rotational speed differential between the driven vacuum feed roll 37 and the drive roll 31. It is contemplated that a suitable tension control, such as another dancer roll, a festoon or other suitable control may also be disposed intermediate the drive roll 31 and the vacuum feed roll 37 instead of or in addition to the load cell 41.

Driven rotation of the vacuum feed roll 37 feeds the continuous web 23*b*, still under tension, to a cutting station, indicated generally at 43, of the web handling system 21. The cutting station 43 suitably comprises a knife roll 45 and a rotatably driven anvil roll 47, with one or more cutting mechanisms (e.g., cutting blades) disposed on the knife roll for cutting the continuous web 23*b* into discrete webs 23*a* (broadly, discrete segments) at regular intervals. That is, the length of the discrete web 23*a* at the cutting station (referred to further herein as the "cut length" of the discrete webs of absorbent material) is generally dependent on the driven rotational speed of the anvil roll 47, the vacuum level of the anvil roll and the speed of the feed roll 37, and where more than one anvil is used it is also dependent on the spacing between anvils. Thus, the cut length may be preset by the operator of the web handling system 21 by setting the anvil roll 47 rotational speed, vacuum level, and/or feed roll rotational speed, or it may be controlled by a suitable speed control (not shown) based on a predetermined target cut length. The machine direction MD path along which the web 23*b* is moved from the vacuum feed roll 37 to the anvil roll 47 is identified as path P3 in FIG. 1.

The term "length" as used in reference to the web 23*b*, or discrete web 23*a* (i.e., discrete segment), of material refers to the length thereof in the machine direction MD, i.e., the direction in which the web is stretched prior to and then retracted subsequent to cutting and/or processing. The length does not necessarily refer to the longest planar dimension of the discrete web 23*a* after cutting (or discrete segment of a continuous web after processing). The drive roll 31, vacuum feed roll 37 and anvil roll 47 together broadly define herein a delivery system that is operable to unwind the continuous web 23*b* from the wound roll 25 and deliver the continuous web to the cutting station 43.

A vacuum transfer roll 49 receives the discrete webs 23*a* from the anvil roll 47 after cutting and transfers the discrete webs onto a suitable transfer device, such as a vacuum conveyor 50, for transport in the machine direction MD away from the cutting station. Additional transfer devices (not shown) further transport the discrete webs 23*a* to the manufacturing line 29, where the discrete webs may be assembled with (e.g., adhered or bonded to) other components of the absorbent product moving along the manufacturing line.

One or more detection or monitoring systems for detecting and determining the length, or other suitable characteristics, of the discrete webs 23*a* at particular locations or at a time after cutting are disposed at predetermined locations, such as intermediate the vacuum transfer roll 49 and the manufacturing line 29. For example, in the illustrated embodiment an inspection system 55, and more suitably a vision inspection system, is located downstream (in the machine direction MD) from the vacuum transfer roll 49 at a distance therefrom to determine the length of the discrete web 23*a* as the web approaches the manufacturing line 29.

It should be recognized that the detection or monitoring systems, such as the inspection system 55, are optional and may be omitted in some embodiments. In addition, the cutting station 43 and the vacuum transfer roll 49 may be omitted in some embodiments. For example, the continuous web 23*b* may be unwound as described above, and may be fed through an intermediate process, such as calendering. The continuous web 23*b* may be rewound at a later stage or process as desired. It should be recognized that the above-described embodiments are illustrative, rather than limiting, and embodiments, processes, and/or components of web handling system 21 may be added, removed, or modified as desired.

The machine direction MD distances between the various components and stations of the web handling system 21 and manufacturing line 29 illustrated in FIG. 1 are not necessarily to scale but are otherwise generally indicative of the relative spacing between such components. Thus, given the speed of the moving web 23*b* (which may be monitored by various speed sensors, not shown, disposed along the paths P1, P2 or at other locations along the web handling system 21) and the known machine direction MD distance between any two stations or system components, the time that the web takes to reach any particular station or component may be readily determined.

During operation of the illustrated web handling system 21, the continuous web 23*b* may experience various levels of tension for certain periods of time prior to reaching the cutting station 43 (or other processing station). For example, while on the wound roll 25, the continuous web 23*b* is subjected to both radial and circumferential stresses that contribute to what is referred to herein as a wound off tension (i.e., the tension in the continuous web as the web is unwound from the wound roll during operation).

Figure 2:
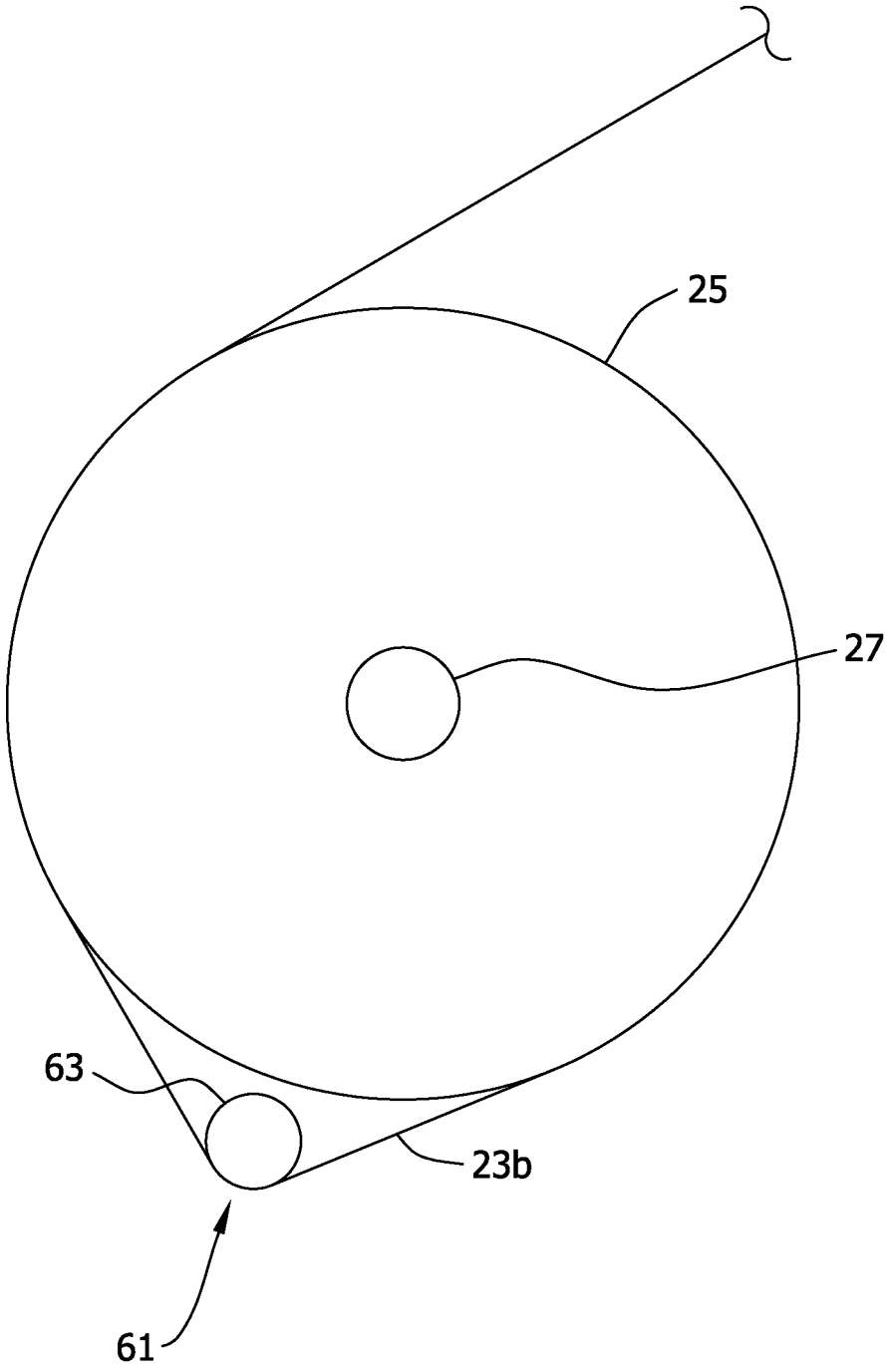
FIG. 2 is a schematic diagram of an unwind spindle, wound roll of web material, and a wound off tensioning monitoring system of the web handling system of FIG. 1.

In one particularly suitable embodiment, the wound off tension may be determined by a suitable wound off tension monitoring system, generally indicated as 61 in FIG. 2, as the web 23*b* is unwound from the wound roll 25. For example, the illustrated wound off tension monitoring system 61 comprises a load cell 63 (similar to the load cell 41 used to determine the tension in the web along path P2 in the system 21 of FIG. 1) located within the wound roll 25 between the outermost wind and the immediately underlying wind of the continuous web 23*b*. The load cell 63 measures the tension in the outermost wind (which is about to be wound off from the roll 25) in pounds. Dividing this tension by the average thickness and average width of the web determines the wound off stress, in pounds per square inch, of the continuous web.

In alternative embodiments, the wound off tension may be pre-determined, such as during initial winding of the continuous web 23*b* onto the wound roll 25 or on a separate winding system (not shown) disposed offline from the web handling system 21, to develop a wound off tension profile in which the wound off tension is recorded as a function of the radius of the wound roll 25 or as a function of the linear location along the length of the continuous web 23*b* on the wound roll. In such an embodiment, the wound off tension monitoring system 61 may comprise a suitable sensor (not shown) for monitoring the radius of the wound roll 25 and/or the linear location of the web 23*b* along the wound roll.

With reference again to FIG. 1, the illustrated web handling system 21 further comprises a control system 71 for controlling operation of the web handling system. The control system 71 may be part of, or may provide input to and receive feed back from, a manufacturing control system (not shown) of the manufacturing line 29 to which the discrete webs are supplied for incorporation into the absorbent product. The control system 71 is suitably in communication with the various operating components of the system 21 and is capable of monitoring and adjusting (or causing to be adjusted) various operating parameters of the system (as indicted by the arrows drawn between the control system and the respective operating components in FIG. 1). The parameters may include, without limitation, the speeds of the drive roll 31, vacuum feed roll 37 and other transfer devices to thereby control the machine direction MD speed of the continuous web 23*b* (to the cutting station 43) and discrete webs 23*a* (downstream of the cutting station), the tension in the web along paths P1, P2 and P3, and/or the cut length of the discrete webs at the cutting station. The control system 71 also suitably communicates with and receives input from the wound off tension monitoring system 61, the load cell 63 and the inspection system 55. The control system 71 may suitably comprise a control circuit, a computer that executes control software, a programmable logic controller and/or other suitable control devices. For example, in one suitable embodiment, control system 71 includes at least one drive controller 73 that controls the rotational drive speed of one or more motors, such as motors (not shown) of the drive roll 31, the vacuum feed roll 37, and/or the vacuum transfer roll 49.

The drive controller 73 is programmed to maintain a substantially uniform tension of the continuous web 23*b*, for example, to prevent the material of the web from tearing when the web is being accelerated or decelerated. The uniform torque is maintained by substantially matching a rotational speed of the drive roll 31, the vacuum feed roll 37, the vacuum transfer roll 49, and/or other components of the web handling system 21. More specifically, a speed setpoint, and a speed trajectory for the speed setpoint, are established for the continuous web 23*b* and the rotational components of the web handling system 21. If the drive controller 73 controls the motors to drive, or rotate, the components of the web handling system 21 at speeds substantially equal to the speed setpoints and/or speed trajectories, a substantially uniform tension is facilitated to be maintained.

The drive controller 73 controls the rotational speed of the motors and/or the components of the web handling system 21 by controlling the torque generated by the motors. The generated torque must account for the inertia of the components to cause the components to rotate at the desired speed trajectory during periods of acceleration or deceleration. For example, the drive controller 73 must account for the inertia of the wound roll 25 (and of other components) to calculate the required torque generated by the motor to accelerate or decelerate the wound roll 25 to stay on the trajectory of the speed setpoint while the web handling system 21 ramps up (i.e., accelerates) or slows down (i.e., decelerates). However, the inertia of the wound roll 25 changes over time as the continuous web 23*b* is unwound from the roll. In addition, the density of the continuous web 23*b* affects the inertia of the wound roll 25, and must be accounted for in calculating the inertia of the roll to properly calculate the torque required to achieve the speed trajectory during acceleration and deceleration for the motor controlled by the drive controller 73.

Figure 3:
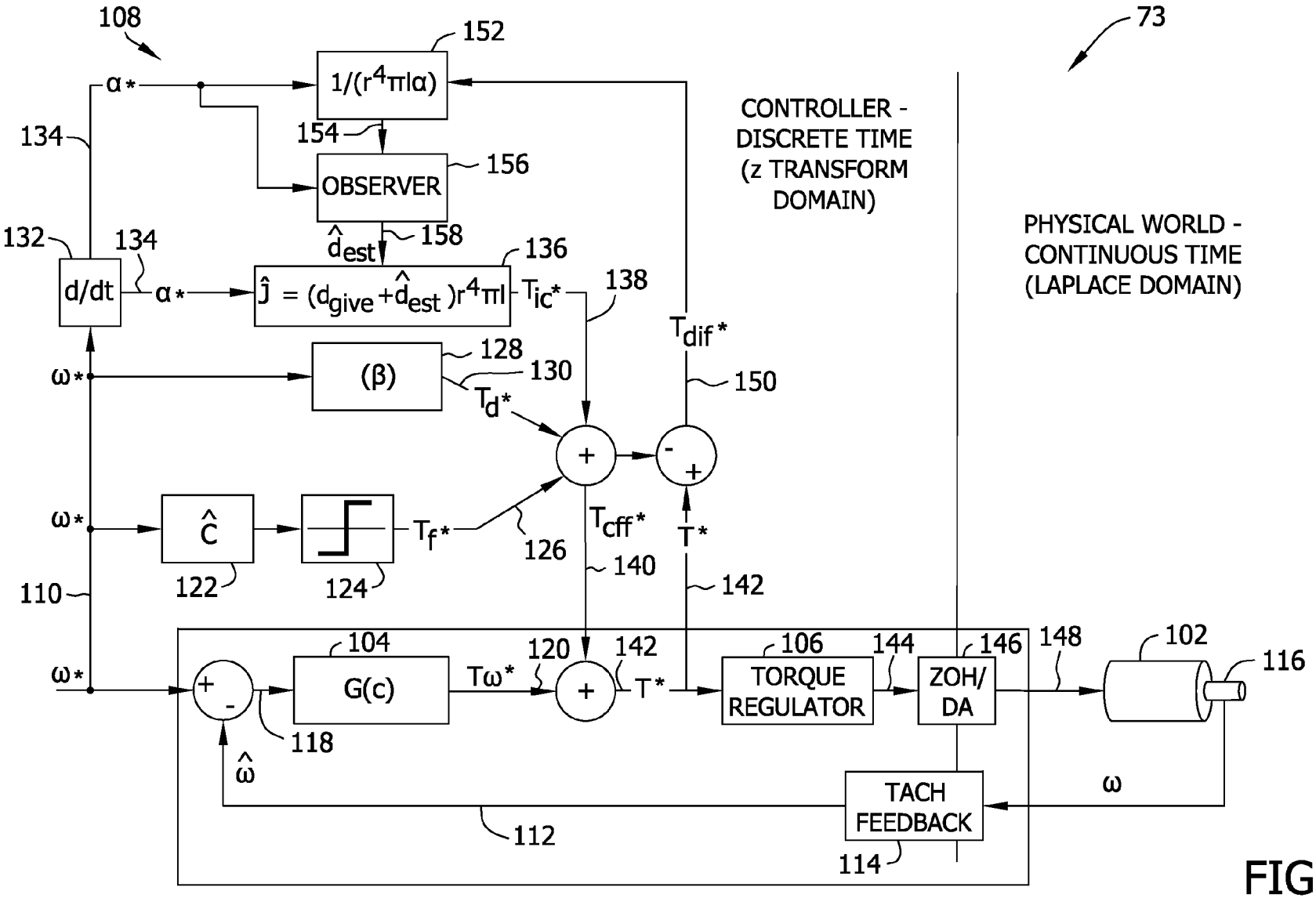
FIG. 3 is a schematic block diagram of one embodiment of a drive controller that may be used with the web handling system of FIG. 1.

FIG. 3 illustrates a schematic block diagram of a drive controller 73 that may be used with the control system 71 shown in FIG. 1. More specifically, the drive controller 73 controls one or more motors 102 of the web handling system 21 and/or the drive mechanism described in FIG. 1, such as one or more motors of the drive roll 31, the vacuum feed roll 37, and/or the vacuum transfer roll 49 shown in FIG. 1.

The drive controller 73 controls the rotational speed of the motor 102 by controlling the torque generated by the motor. The torque causes the drive roll 31, the vacuum feed roll 37, and/or the vacuum transfer roll 49 to move the continuous web 23*b* at a desired speed, as described above.

The drive controller 73 includes a drive speed regulator 104, a torque regulator 106, and a plurality of modules 108 that calculate operating parameters used by the drive controller 73 to control the torque of the motor 102. The modules 108 are embodied within one or more circuits and/or computer-executable software programs within drive controller 73.

The drive controller 73 receives an angular speed command 110 (also known as the rotational speed setpoint) for the motor 102 and receives a measured rotational speed 112 (also known as a measured drive speed) of the motor 102. For example, a speed sensor 114 measures the rotational speed of a drive shaft 116 of the motor 102 and transmits a signal representative of the measured rotational speed to the drive controller 73. The drive controller 73 subtracts the measured rotational speed 112 from the speed command 110 to obtain a speed error signal 118. The speed error signal 118 is transmitted to the drive speed regulator 104.

The drive speed regulator 104 calculates an amount of torque to be generated by the motor to facilitate reducing the speed error signal 118 to zero. The drive speed regulator 104 generates an initial torque command 120 that is representative of the calculated amount of torque.

A Coulomb friction calculation module 122 receives the speed command 110 and calculates an amount of Coulomb friction that is experienced, or expected to be experienced, by the motor 102. The calculated amount of Coulomb friction is limited by a limiter module 124 and is output as a Coulomb friction torque command 126. The Coulomb friction torque command 126 represents an additional amount of torque required to be generated by the motor 102 to compensate for the Coulomb frictional forces.

A damping friction calculation module 128 receives the speed command 110 and calculates an amount of damping friction that is expected to be experienced by windings of the motor 102. The damping friction calculation module 128 generates a damping torque command 130 that is representative of an additional amount of torque required to be generated by the motor 102 to compensate for the damping friction forces.

In addition, a derivation module 132 generates an angular acceleration command 134 by calculating a derivative of the speed command 110. The acceleration command 134 is transmitted to an inertia calculation module 136 that calculates an inertia of the wound roll 25, as described more fully herein. The inertia calculation module 136 generates an inertia torque command 138 (also referred to as an inertia compensation command) that is representative of an additional (or a lower) amount of torque required to be generated by the motor 102 to compensate for changes in the inertia of the wound roll 25, or to account for changes in the estimated inertia and/or density of the wound roll.

The inertia torque command 138, the damping torque command 130, and the Coulomb friction torque command 126 are added together to obtain a feedforward torque command 140. The feedforward torque command 140 is added to the initial torque command 120 to obtain a total torque command 142. The total torque command 142 is representative of the total amount of torque that is expected to be required to achieve the speed setpoint while adjusting for frictional and inertia considerations of the wound roll 25 and/or the web handling system 21. The total torque command 142 is transmitted to the torque regulator 106 to generate a torque signal 144 representative of the total torque command 142. The torque signal 144 is transformed from a discrete, or Z transform domain, to a continuous, or Laplace, time domain using a transform module 146. A drive signal 148 is output from the transform module 146 and is transmitted to the motor 102, thus causing the motor 102 to generate the amount of torque represented by the torque signal 144.

In addition, the total torque command 142 is used to facilitate calculating the inertia and the estimated density of the wound roll 25. More specifically, the feedforward torque command 140 is subtracted from the total torque command 142 to obtain a differential torque command 150. It should be recognized that the differential torque command 150 is equal to the initial torque command 120 output from the drive speed regulator 104. The differential torque command 150 is transmitted to a density error calculation module 152.

The density error calculation module 152 calculates or estimates a density error 154 of the wound roll 25 using the differential torque command 150, the acceleration command 134, and a measured radius (not shown) of the wound roll. The radius of the wound roll 25 is measured, for example, using a proximity sensor (not shown), or any other suitable sensor, that is coupled to, or positioned proximate to, the wound roll to measure a distance from the sensor to an outer surface of the wound roll. The measured distance may be subtracted from a previously measured distance from the sensor to the unwind spindle 27 shown in FIG. 1 to calculate the radius of the wound roll 25 (i.e., the radius of the material wound around the unwind spindle).

The density error calculation module 152 divides the differential torque command 150 by the term ($r^4*n*l*\alpha$), wherein r is the radius of the wound roll material, l is the width of the continuous web 23*b* (in a direction within the plane of the continuous web 23*b* perpendicular to the length of the web), and a is the angular acceleration command 134. Accordingly, the density error calculation module 152 estimates the density error of the wound roll 25 based on the output of the drive speed regulator 104 (i.e., based on the initial torque command 120).

The calculated or estimated density error 154 is transmitted to an observer module 156 that calculates or estimates the density of the wound roll 25. The observer module 156 is tuned to provide an estimated change in density required to force the output of the drive speed regulator 104 (i.e., the initial torque command 120) to be reduced substantially, and in some cases, to zero.

The observer module 156 is implemented as one or more software and/or hardware based algorithms that combine sensed signals with knowledge of the web handling system 21 to enable the observer module 156 to function as described herein. In one embodiment, the observer module 156 is implemented as a proportional integral derivative (PID) controller. The observer module 156 is enabled when the continuous web 23*b* and the wound roll 25 are being accelerated or decelerated, and is disabled when the wound roll 25 and the continuous web 23*b* are maintained at a substantially constant angular speed. The observer module 156 calculates or estimates the change in density 158 required to reduce the initial torque command 120 to zero.

In other words, the observer module 156 incorporates algorithms based on knowledge of the web handling system 21 and effects thereof on the inertia of the wound roll 25 to estimate the change in density. The inertia of a wound roll of material, such as absorbent material, of varying radius, $J_{material}$ can be calculated based on the density, radius, and width of the material using the following formula:

$$J_{material} = \left[\frac{\pi * L * d}{2 * g}\right] * (R_o^4 - R_i^4) \quad \text{Equation 1}$$

where L is the width of the roll, d is the density of the roll material, g is the gravitational constant, $R_o$ is the outer radius of the roll, and $R_i$ is the inner radius of the roll. While L, g, and $R_i$ are constant terms, $R_o$ varies as the roll unwinds and must be accounted for in the calculated inertia. The density, d, will also vary with the grade of the material and environmental factors, and can often be treated as the second variable in the inertia calculation.

Given that observers are based on knowledge of the physical system, the following equations are used in the observer algorithm:

$$J_{total} = J_{material} + J_{system} \quad \text{Equation 2}$$

where $J_{material}$ is the inertia due to the mass of the material, $J_{system}$ is the inertia of the mechanical components between the motor and the roll, and $J_{total}$ is the total inertia;

$$T = J_{total} * \alpha^* \quad \text{Equation 3}$$

where T is the applied torque at the drive shaft of the motor and $\alpha^*$ is the command angular acceleration of the motor; and $$T^* = T_\omega^* + T_{eff}^* \quad \text{Equation 4}$$

where T* is the applied torque reference, $T_\omega^*$ is the torque output of the drive speed regulator, and $T_{eff}^*$ is total command feedforward torque (also referred to herein as the feedforward torque command).

Substituting into equations 1, 2, 3, and 4 yields the error in density, $\Delta d_{est}$, as shown in equation 5.

$$\Delta d_{est} = 2 * g\left[\frac{T^* - T_{eff}^*}{\pi * L * \alpha^*}\right] \Big/ (R_o^4 - R_i^4) \quad \text{Equation 5}$$

The estimated change in density 158 (i.e., $\Delta d_{est}$) is calculated accordingly and is transmitted to the inertia calculation module 136. More specifically, the estimated density error 154 calculated by the density error calculation module 152 is used with the equations described above to determine the required change in density. In one embodiment, the observer module 156 uses the knowledge of the web handling system 21 (e.g., the equations described above) to set the estimated change in density 158 equal to the estimated density error 154.

The inertia calculation module 136 calculates the inertia based on the estimated change in density 158. More specifically, the inertia calculation module 136 adds the estimated change in density 158 and a current density value of the wound roll 25 to obtain an adjusted density value. The current density value may be a "hardcoded" value entered by a user or an administrator based on a typical density value for the material of the continuous web 23*b*. Alternatively, the current density value may be the density value from a prior calculation of the inertia calculation module 136 (e.g., the prior adjusted density value). The adjusted density value is multiplied by the term ($r^4$*n*l*$\alpha$) described above to obtain the inertia torque command 138.

Accordingly, the drive controller 73 calculates an estimated density of the wound roll 25 based on the output of the drive speed regulator 104 and incorporates the estimated density into an inertia compensation feedforward path (e.g., the inertia calculation module 136) to facilitate reducing the output of the drive speed regulator 104 to zero. Therefore, the drive controller 73 facilitates enabling a drive speed trajectory to be more accurately followed during acceleration or deceleration periods by a motor 102 as compared to at least some prior art systems.

When introducing elements of the present invention or the preferred embodiment(s) thereof, the articles "a", "an", "the", and "said" are intended to mean that there are one or more of the elements. The terms "comprising," "including", and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A controller for a motor configured to rotate a roll of material, the controller comprising:

a drive speed regulator configured to generate an initial torque command based on a difference between a speed setpoint and a measured drive speed of the motor, wherein the initial torque command represents an amount of rotational force currently applied to the roll of material by the motor;

an observer module configured to estimate a density error of the roll of material based at least in part on the initial torque command and the speed setpoint, wherein the initial torque command is adjusted based on the density error to obtain a total torque command, wherein the observer module is enabled if the roll of material is one of accelerating and decelerating, and wherein the observer module is disabled if the roll of material is being maintained at a substantially constant speed; and a torque regulator configured to control the motor based on the total torque command, wherein a Coulomb friction torque command is generated based on an expected amount of Coulomb friction experienced by the motor, wherein the total torque command is further based on the Coulomb friction torque command.

2. The controller as set forth in claim 1, wherein the observer module is configured to transmit the estimated density error to an inertia calculation module configured to calculate an inertia of the roll of material.

3. The controller as set forth in claim 2, wherein the inertia calculation module is configured to generate an inertia torque command based on the calculated inertia of the roll of material.

4. The controller as set forth in claim 3, wherein a feedforward torque command is added to the initial torque command to obtain the total torque command.

5. The controller as set forth in claim 4, wherein the feedforward torque command is based at least partially on the inertia torque command.

6. The controller as set forth in claim 5, wherein a damping torque command is generated based on an expected amount of damping friction of the motor, the feedforward torque command being further based on the damping torque command.

7. The controller as set forth in claim 6, wherein the feedforward torque command being further based on the Coulomb friction torque command.

8. A web handling system for use with a roll of material, the web handling system comprising:

a motor configured to one of unwind and wind the roll of material; and a controller configured to control a drive speed of the motor, the controller comprising:

a drive speed regulator configured to generate an initial torque command based on a difference between a speed setpoint and a measured drive speed of the motor, wherein the initial torque command represents an amount of rotational force currently applied to the roll of material by the motor;

an observer module configured to estimate a density error of the roll of material based at least in part on the initial torque command and the speed setpoint, wherein the initial torque command is adjusted based on the density error to obtain a total torque command, wherein the observer module is enabled if the roll of material is one of accelerating and decelerating, and wherein the observer module is disabled if the roll of material is being maintained at a substantially constant speed; and a torque regulator configured to control the motor based on the total torque command, wherein a Coulomb friction torque command is generated based on an expected amount of Coulomb friction experienced by the motor, wherein the total torque command is further based on the Coulomb friction torque command.

9. The web handling system as set forth in claim 8, wherein the observer module is configured to transmit the estimated density error to an inertia calculation module configured to calculate an inertia of the roll of material.

10. The web handling system as set forth in claim 9, wherein the inertia calculation module is configured to generate an inertia torque command based on the calculated inertia of the roll of material.

11. The web handling system as set forth in claim 10, wherein a feedforward torque command is added to the initial torque command to obtain the total torque command.

12. The web handling system as set forth in claim 11, wherein the feedforward torque command is based at least partially on the inertia torque command.

13. The web handling system as set forth in claim 12, wherein a damping torque command is generated based on an expected amount of damping friction of the motor, the feedforward torque command being further based on the damping torque command.

14. The web handling system as set forth in claim 13, wherein the feedforward torque command being further based on the Coulomb friction torque command.

* * * * *